US011123615B2

(12) United States Patent
Milleman et al.

(10) Patent No.: US 11,123,615 B2
(45) Date of Patent: Sep. 21, 2021

(54) GOLF CLUB HEADS WITH VARIABLE FACE GEOMETRY AND MATERIAL PROPERTIES

(71) Applicant: KARSTEN MANUFACTURING CORPORATION, Phoenix, AZ (US)

(72) Inventors: Travis Milleman, Portland, OR (US); Matthew Simone, Phoenix, AZ (US); Evan Greer, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/878,494

(22) Filed: Jan. 24, 2018

(65) Prior Publication Data

US 2018/0154226 A1 Jun. 7, 2018

Related U.S. Application Data

(63) Continuation-in-part of application No. PCT/US2016/044335, filed on Jul. 27, 2016.
(Continued)

(51) Int. Cl.
*A63B 53/04* (2015.01)
*A63B 53/08* (2015.01)
(Continued)

(52) U.S. Cl.
CPC ..... *A63B 53/08* (2013.01); *A63B 53/04* (2013.01); *A63B 53/047* (2013.01);
(Continued)

(58) Field of Classification Search
CPC ..... A63B 53/08; A63B 53/047; A63B 53/06; A63B 53/0466; A63B 53/04; A63B 53/005; A63B 53/042; A63B 53/0408; A63B 53/0416; A63B 53/0458; A63B 53/0462; A63B 2102/32; A63B 2209/00; A63B 60/00
See application file for complete search history.

(56) References Cited

U.S. PATENT DOCUMENTS 3,368,812 A 2/1968 Baldwin, Sr.
3,937,474 A 2/1976 Jepson et al.
(Continued)

FOREIGN PATENT DOCUMENTS

JP 2010051618 A * 3/2010
JP 2010051627 A * 3/2010

OTHER PUBLICATIONS

International Search Report and Written Opinion for Application No. PCT/US2016/044335 dated Oct. 21, 2016.

*Primary Examiner* — Stephen L Blau

(57) ABSTRACT

Embodiments of golf club heads with variable face geometry and material properties are described herein. Various embodiments include a golf club head comprising a body configured to receive a faceplate from a set of faceplates. The body comprises a heel region, a toe region opposite the heel region, a sole, and a crown. The faceplate is from the set of faceplates and coupled to the body. The set of faceplates comprises a heel region, a toe region, a top portion, and a bottom portion, and further comprises at least one of a varying hardness profile or a varying thickness profile. Other examples and related methods are also disclosed herein.

3 Claims, 11 Drawing Sheets

Related U.S. Application Data

(60) Provisional application No. 62/197,167, filed on Jul. 27, 2015.

(51) Int. Cl.
*A63B 53/06* (2015.01)
*A63B 53/00* (2015.01)
*A63B 102/32* (2015.01)

(52) U.S. Cl.
CPC ..... *A63B 53/0466* (2013.01); *A63B 53/06* (2013.01); *A63B 53/005* (2020.08); *A63B 53/042* (2020.08); *A63B 53/0408* (2020.08); *A63B 53/0416* (2020.08); *A63B 53/0458* (2020.08); *A63B 53/0462* (2020.08); *A63B 2102/32* (2015.10); *A63B 2209/00* (2013.01)

(56) References Cited

U.S. PATENT DOCUMENTS 4,364,159 A * 12/1982 Holcombe ..... B23P 15/10 123/193.6
4,432,549 A * 2/1984 Zebelean ..... A63B 53/04 473/346
4,884,808 A 12/1989 Retzer
5,024,437 A * 6/1991 Anderson ..... A63B 53/04 473/342
5,141,231 A * 8/1992 Cox ..... A63B 53/0466 473/330
5,261,663 A * 11/1993 Anderson ..... A63B 53/04 473/342
5,356,138 A * 10/1994 Chen ..... A63B 53/04 473/291
5,362,047 A * 11/1994 Shaw ..... A63B 53/04 473/291
5,362,311 A * 11/1994 Amino ..... A61F 2/3609 623/22.45
5,405,136 A * 4/1995 Hardman ..... A63B 53/04 473/342
5,423,535 A * 6/1995 Shaw ..... A63B 53/04 473/291
5,674,132 A 10/1997 Fisher
5,971,868 A * 10/1999 Kosmatka ..... A63B 53/04 473/349
6,428,425 B1 8/2002 Naruo et al.
6,440,011 B1 8/2002 Hocknell et al.
6,652,391 B1 * 11/2003 Kubica ..... A63B 53/02 473/345
6,776,726 B2 8/2004 Sano
6,908,400 B2 * 6/2005 Chu ..... A63B 53/14 473/303
7,235,023 B2 * 6/2007 Sugimoto ..... A63B 53/047 473/291
8,333,667 B2 * 12/2012 Kumamoto ..... A63B 53/04 473/342
8,500,573 B2 * 8/2013 Rick ..... A63B 53/047 473/342
8,529,368 B2 * 9/2013 Rice ..... A63B 53/04 473/329
2002/0052247 A1 5/2002 Helmstetter et al.
2002/0091014 A1 7/2002 Aldrich
2003/0013543 A1 1/2003 Helmstetter et al.
2003/0042680 A1 3/2003 Harada et al.
2003/0060306 A1 3/2003 Aldrich
2003/0131911 A1 * 7/2003 Grimm ..... C21D 1/18 148/335
2003/0153397 A1 * 8/2003 Roach ..... A63B 53/047 473/290
2004/0053704 A1 * 3/2004 Gilbert ..... A63B 53/047 473/290
2004/0147335 A1 * 7/2004 Iwata ..... A63B 53/04 473/291
2004/0189179 A1 * 9/2004 Karita ..... H01J 29/073 313/407
2005/0164802 A1 7/2005 Wood et al.
2006/0094531 A1 * 5/2006 Bissonnette ..... A63B 53/0466 473/329
2006/0094532 A1 5/2006 Seeley
2007/0173346 A1 7/2007 Chiang et al.
2008/0242441 A1 * 10/2008 Chen ..... A63B 53/04 473/329
2009/0023513 A1 * 1/2009 Shibata ..... A63B 53/047 473/305
2009/0088807 A1 * 4/2009 Castaneda ..... A61B 17/8047 606/286
2012/0021849 A1 1/2012 Gibbs et al.
2012/0063857 A1 * 3/2012 Onozawa ..... B23B 51/048 408/200
2015/0045143 A1 * 2/2015 Abe ..... A63B 60/00 473/330
2015/0045145 A1 * 2/2015 Nishio ..... A63B 53/04 473/330
2015/0045147 A1 * 2/2015 Abe ..... A63B 60/00 473/345
2015/0126304 A1 * 5/2015 Cleghorn ..... A63B 60/52 473/338
2015/0308275 A1 * 10/2015 Pabla ..... B05D 1/36 428/142

* cited by examiner

GOLF CLUB HEADS WITH VARIABLE FACE GEOMETRY AND MATERIAL PROPERTIES

CROSS REFERENCE TO RELATED APPLICATIONS

This is a continuation in part of PCT Application No. PCT/US16/44335, filed on Jul. 27, 2016, which claims the benefit of U.S. Provisional Patent Application No. 62/197,167, filed on Jul. 27, 2015, the contents of which above are incorporated fully herein by reference.

TECHNICAL FIELD

This disclosure relates generally to golf clubs, and relates more particularly to golf club heads with variable face geometry and material properties.

BACKGROUND

Golf club manufacturers design golf club heads to improve the distance and flight path of a golf ball upon impact with a faceplate of a golf club head. There is a need in the art golf club heads having faceplates with varying geometries or material properties to affect spin characteristics of a golf ball, such as to overcome a fade or draw bias.

BRIEF DESCRIPTION OF THE DRAWINGS

To facilitate further description of the embodiments, the following drawings are provided in which.

Figure 1:
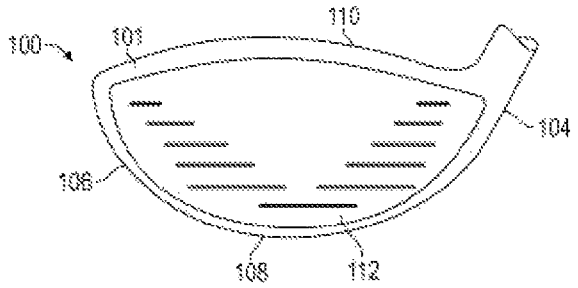
FIG. 1 depicts a front, toe-side perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

The term "varying hardness profile", as defined herein, refers to a hardness profile of a faceplate wherein the hardness profile may vary in a direction moving toward a heel region, a toe region, a sole, a crown, or any combination of the described directions. The hardness profile does not vary, however, in a depth direction moving from an outer surface or striking surface to an inner surface of the faceplate, or in a direction moving from the inner surface to the outer surface or striking surface of the faceplate at a particular position on the faceplate. For example, at any particular position on the faceplate (e.g. near the heel region, near the toe region, near the crown, or near the sole), the hardness is substantially the same throughout the entire faceplate depth.

DETAILED DESCRIPTION

Various embodiments of golf club heads with variable face geometry and material properties include a golf club head comprising a body configured to receive a faceplate from a set of faceplates. The body comprises a heel region, a toe region opposite the heel region, a sole, and a crown. The faceplate is from the set of faceplates and coupled to the body. The set of faceplates comprises at least one of a varying hardness profile or a varying thickness profile. In some embodiments, a first faceplate of the set of faceplates comprises a heel region, a toe region, a top portion, and a bottom portion, and further comprises a first hardness profile if the set of faceplates comprise the varying hardness profile or a first thickness profile if the set of faceplates comprise the varying thickness profile. A second faceplate of the set of faceplates comprises a heel region, a toe region, a top portion, and a bottom portion, and further comprises a second hardness profile if the set of faceplates comprise the varying hardness profile or a second thickness profile if the set of faceplates comprise the varying thickness profile. A third faceplate of the set of faceplates comprises a heel region, a toe region, a top portion, and a bottom portion, and further comprises a third hardness profile if the set of faceplates comprise the varying hardness profile or a third thickness profile if the set of faceplates comprise the varying thickness profile.

Other embodiments of golf club heads with variable face geometry and material properties include a set of golf club heads. The set of golf club heads comprise a first golf club head, a second golf club head, and a third golf club head. In many embodiments, the first golf club head comprises a first body configured to receive a first faceplate of a set of faceplates, wherein the set of faceplates comprises at least one of a varying hardness profile or a varying thickness profile. The first body comprises a first heel region, a first toe region opposite the first heel region, a first sole, and a first crown. The first golf club head further comprises the first faceplate of the set of faceplates and the first faceplate of the set of faceplates is coupled to the first body. The first faceplate of the set of faceplates comprises a heel region, a toe region, a top portion, and a bottom portion, and further comprises at least one of a first hardness profile if the set of faceplates comprise the varying hardness profile or a first thickness profile if the set of faceplates comprise the varying thickness profile. The set of golf club heads further comprises a second golf club head. The second golf club head comprises a second body configured to receive a second faceplate of the set of faceplates. The second body comprises a second heel region, a second toe region opposite the second heel region, a second sole, and a second crown. The second golf club head further comprises a heel region, a toe region, a top portion, and a bottom portion, and further comprises the second faceplate of the set of faceplates, the second faceplate of the set of faceplates is coupled to the second body. The second faceplate of the set of faceplates comprises at least one of a second hardness profile if the set of faceplates comprise the varying hardness profile or a second thickness profile if the set of faceplates comprise the varying thickness profile. The set of golf club heads further comprises a third golf club head. The third golf club head comprises a third body configured to receive a third faceplate of the set of faceplates. The third body comprises a third heel region, a third toe region opposite the third heel region, a third sole, and a third crown. The third golf club head further comprises the third faceplate of the set of faceplates, the third faceplate of the set of faceplates is coupled to the third body. The third faceplate of the set of faceplates comprises a heel region, a toe region, a top portion, and a bottom portion, and further comprises at least one of a third hardness profile if the set of faceplates comprise the varying hardness profile or a third thickness profile if the set of faceplates comprise the varying thickness profile.

Other embodiments include a golf club comprising a body configured to receive a faceplate from a set of faceplates. The body comprises a heel region, a toe region opposite the heel region, a sole, and a crown. The golf club further comprises the faceplate from the set of faceplates and coupled to the body, a shaft coupled to the body, and a grip coupled to the shaft. In many embodiments, the set of faceplates comprises at least one of a varying hardness profile or a varying thickness profile. In some embodiments, a first faceplate of the set of faceplates comprises a heel region, a toe region, a top portion, and a bottom portion, and further comprises a first hardness profile if the set of faceplates comprise the varying hardness profile or a first thickness profile if the set of faceplates comprise the varying thickness profile. In some embodiments, a second faceplate of the set of faceplates comprises a heel region, a toe region, a top portion, and a bottom portion, and further comprises a second hardness profile if the set of faceplates comprise the varying hardness profile or a second thickness profile if the set of faceplates comprise the varying thickness profile. In some embodiments, a third faceplate of the set of faceplates comprises a heel region, a toe region, a top portion, and a bottom portion, and further comprises a third hardness profile if the set of faceplates comprise the varying hardness profile or a third thickness profile if the set of faceplates comprise the varying thickness profile.

Other embodiments of golf club heads with variable face geometry and material properties include a method for manufacturing a golf club head. In many embodiments, the method comprises forming a body from a material having a first density, the body configured to receive a faceplate from a set of faceplates. The body comprises a heel region, a toe region opposite the heel region, a sole, and a crown. The method further comprises forming the set of faceplates and attaching one faceplate from the set of faceplates to the body. In many embodiments, the set of faceplates comprises at least one of a varying hardness profile or a varying thickness profile. In some embodiments, a first faceplate of the set of faceplates comprises a heel region, a toe region, a top portion, and a bottom portion, and further comprises a first hardness profile if the set of faceplates comprise the varying hardness profile or a first thickness profile if the set of faceplates comprise the varying thickness profile. In some embodiments, a second faceplate of the set of faceplates comprises a heel region, a toe region, a top portion, and a bottom portion, and further comprises a second hardness profile if the set of faceplates comprise the varying hardness profile or a second thickness profile if the set of faceplates comprise the varying thickness profile. In some embodiments, a third faceplate of the set of faceplates comprises a heel region, a toe region, a top portion, and a bottom portion, and further comprises a third hardness profile if the set of faceplates comprise the varying hardness profile or a third thickness profile if the set of faceplates comprise the varying thickness profile.

Turning to the drawings, FIG. 1 illustrates a front, toe-side perspective view of an embodiment of a golf club head 100. In some embodiments, golf club head 100 can be a driver-type golf club head. In other embodiments, golf club head 100 can be a wood-type, fairway wood, or a hybrid-type golf club head. Golf club head 100 comprises a body 101. In some embodiments, body 101 can be molded as a single piece or in multiple piece assemblies. In many embodiments, body 101 comprises a heel region 104, a toe region 106 opposite heel region 104, a sole 108, and a crown 110. In many embodiments, body 101 can be configured to receive a faceplate from a set of faceplates, such as a set of faceplates 200 (FIG. 2), a set of faceplates 300 (FIG. 3), and/or a set of faceplates 400 (FIG. 4). The ability to couple different faceplates to a single body type can allow the ability to create different club heads with approximately the same center of gravity position, but different performance characteristics, such as, but not limited to spin, trajectory, and coefficient of restitution. Specifically, the interchangeable faceplate can achieve different performance characteristics such as low spin or draw spin using variable geometries and/or material properties.

In many embodiments, the set of faceplates comprise varying material properties and/or geometries. In some embodiments, the set of faceplates comprises at least one of a varying hardness profile (FIGS. 2-3) and/or a varying thickness profile (FIGS. 4-5). Each faceplate (e.g., faceplates 211, 222, and 233 of set of faceplates 200 (FIGS. 2A-2C), faceplates 311, 322, and 333 of set of faceplates 300 (FIGS. 3A-3C), or faceplates 411, 422, and 433 of set of faceplates 400 (FIGS. 4A-4C)) can independently influence the spin and/or trajectory of a golf ball, and can be coupled to body 101, resulting in different golf club heads with different performance characteristics, such as, but not limited to spin, traj ectory, and coefficient of restitution. For example, the set of faceplates can be used to create different club heads with different spin characteristics (i.e. toe bias, neutral, heel bias, reduced backspin, etc.) without significantly affecting the club head center of gravity position.

Each faceplate comprises a heel region, a toe region, a top portion and a bottom portion. In many embodiments, faceplate is coupled to body 101. In many embodiments, faceplate from any number of sets of faceplates is coupled to body 101. In some embodiments, as illustrated in FIGS. 1-4, the faceplate can be a relatively planar insert to be coupled to body 101. In these embodiments, body 101 can form at least part of the front face of golf club head 100 (along with the faceplate insert), and in some of these embodiments, body 101 can even form part of the strike face of golf club head 100 (along with the faceplate insert). In other embodiments, the faceplate can be a "c-shaped" or a cup style insert. In these other embodiments, the "c-shaped" or cup style insert, after being coupled to the body, can extend past the front face of the golf club head and can form a front part of the crown and/or a front part of the sole of the golf club head. In these other embodiments, the "c-shaped" or cup style insert can form all of the front face and/or all of the strike face of the golf club head, while the body does not form any part of the front face or the strike face of the golf club head. In other embodiments, the body can comprise various components and/or materials (e.g., metal or non-metal) that can be coupled together to form the body, and the faceplate can be coupled to the multi-component club head body.

In many embodiments, the heel region, toe region, top portion and bottom portion of the faceplate are positioned with reference to a centerpoint of the faceplate. The centerpoint of the faceplate can be located in accordance with the definition of a golf governing body such as the United States Golf Association (USGA). For example, the centerpoint can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

A vertical axis extending through the centerpoint of the faceplate perpendicular to a ground plane separates the heel region and the toe region of the faceplate. For example, the heel region of the faceplate can be located on a side of the vertical axis near the heel region 104 of the club head 100, and the toe region of the faceplate can be located on a side of the vertical axis near the toe region 106 of the club head 100. A horizontal axis extending through the centerpoint of the faceplate parallel to the ground plane separates the top portion and bottom portion of the faceplate. For example, the top portion of the faceplate can be located on a side of the horizontal axis near the crown 110 of the club head 100, and the bottom portion of the faceplate can be located on a side of the horizontal axis near the sole 108 of the club head 100.

Turning to FIGS. 2-3, FIG. 2 depicts exterior surfaces of set of faceplates 200 comprising a first faceplate 211, a second faceplate 222, and a third faceplate 233. FIG. 3 depicts exterior surfaces of a similar set of faceplates 300 comprising a first faceplate 311, a second faceplate 322, and a third faceplate 333. In many embodiments, a set of faceplates (e.g., set of faceplates 200 (FIG. 2)) can comprise at least 3 faceplates. In some embodiments, the set of faceplates can comprise any number of faceplates greater than one, such as 2, 3, 4, 5, 6, 7, 8, 9, 10, or any other number of different types of faceplates. The faceplates described herein can be made of any material including titanium, steel, steel alloys, stainless steel, other metals, metal alloys, non-metals, polymers, carbon fiber based materials, or composites. In many embodiments, each faceplate within a set of faceplates is made of the same material. However, in other embodiments, different faceplates within a set of faceplates can be made of different materials.

A. Varying Hardness Profiles

Figure 2A:
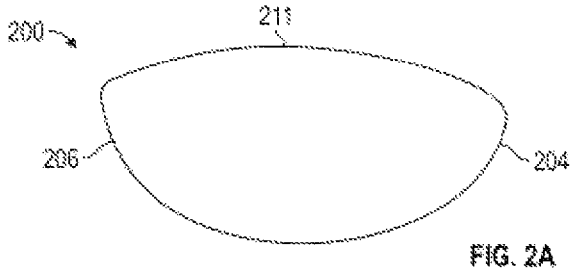
FIG. 2A depicts a faceplate within a set of faceplates having variable hardness profiles according to an embodiment.
Figure 2B:
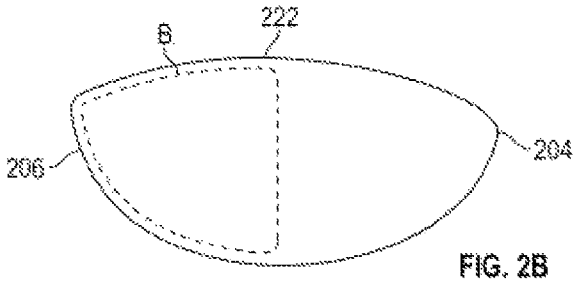
FIG. 2B depicts another faceplate within the set of faceplates of FIG. 2A.
Figure 2C:
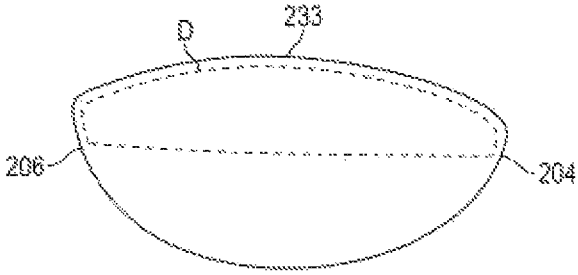
FIG. 2C depicts another faceplate within the set of faceplates of FIGS. 2A and 2B.
Figure 3A:
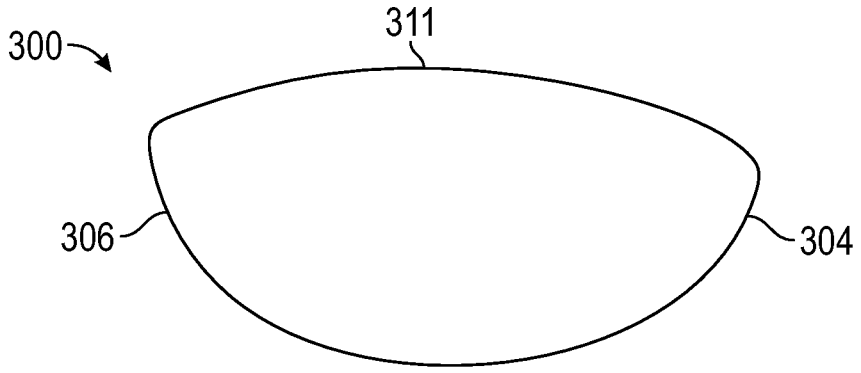
FIG. 3A depicts a faceplate within a set of faceplates having variable hardness profiles according to another embodiment.
Figure 3B:
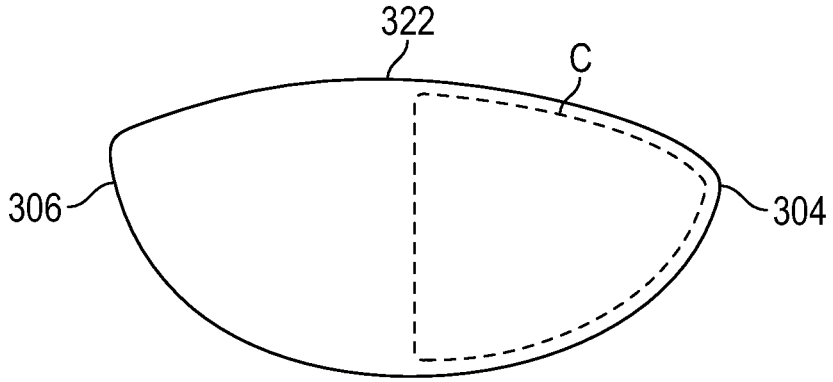
FIG. 3B depicts another faceplate within the set of faceplates of FIG. 3A.
Figure 3C:
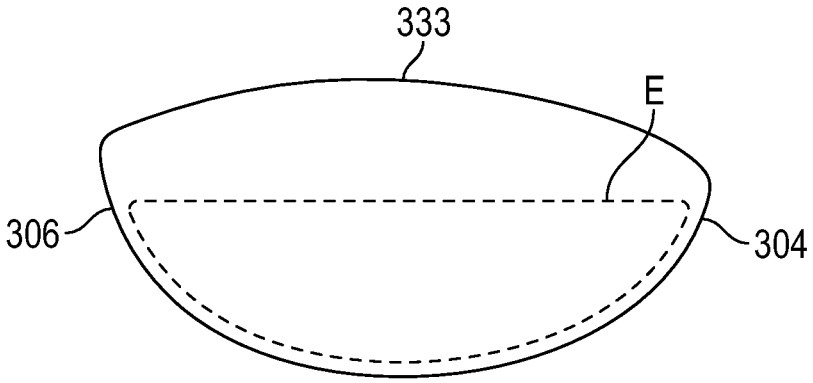
FIG. 3C depicts another faceplate within the set of faceplates of FIGS. 3A and 3B according to another embodiment.
Figure 4A:
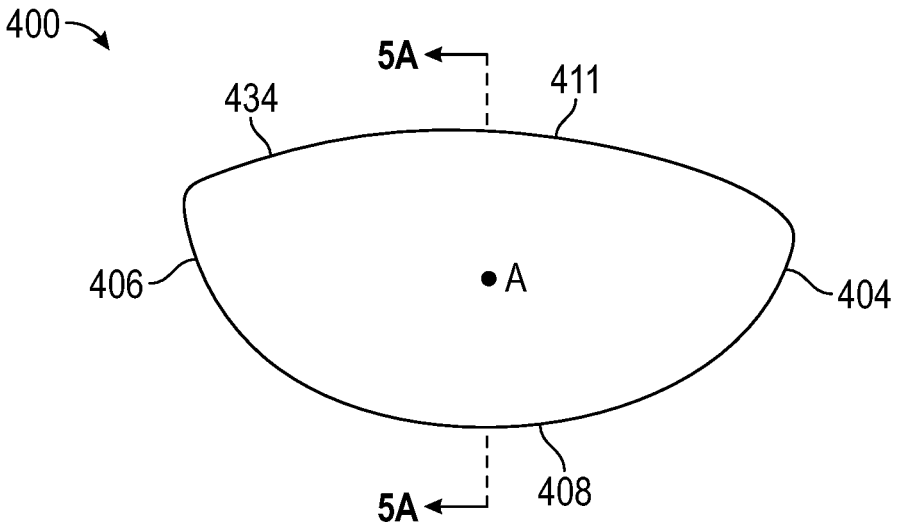
FIG. 4A depicts a faceplate within a set of faceplates having a variable thickness profile according to an embodiment.
Figure 4B:
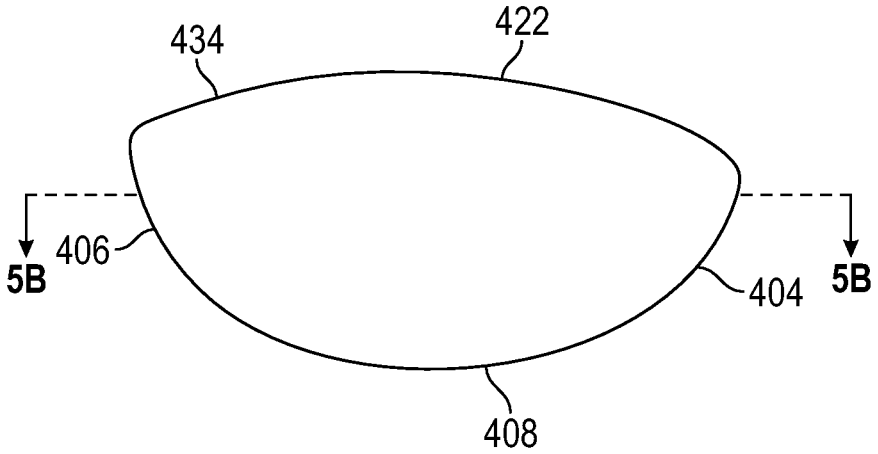
FIG. 4B depicts another faceplate within the set of faceplates of FIG. 4A.
Figure 4C:
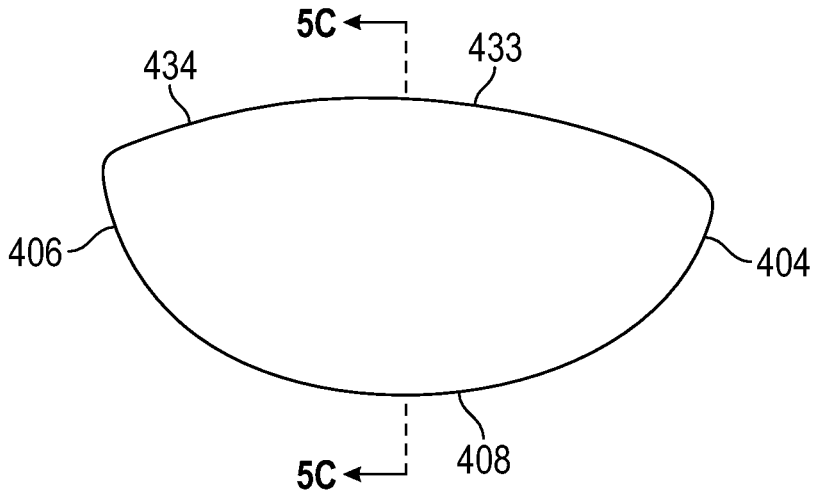
FIG. 4C depicts another faceplate within the set of faceplates of FIGS. 4A and 4B.

Referring to FIGS. 2-3, set of faceplates 200 and 300 comprise varying hardness profiles, but only one of these faceplates is coupled to the golf club head body to provide different performance characteristics for the golf club. Each faceplate within the set of faceplates (e.g., faceplates 211, 222, and 233 of set of faceplates 200 (FIGS. 2A-2C), or faceplates 311, 322, and 333 of set of faceplates 300 (FIGS. 3A-3C)) comprise a hardness profile having a maximum hardness and a minimum hardness. Within a faceplate, the hardness profile can have an area of maximum hardness, minimum hardness, or a varying degree of hardness. The hardness of these various areas on and within the faceplate can be measured by any standard hardness measurement scale, for example, the Rockwell scale and the HRC unit (using a 120° diamond spheroconical).

In many embodiments, first faceplates 211 and 311 comprise a first hardness profile. The first hardness profile comprises a uniform hardness across the first faceplate such that the maximum hardness and the minimum hardness are approximately equal. In many embodiments, first faceplates 211 and 311 can be standard faceplates.

Referring to FIGS. 2B and 3B, in many embodiments, second faceplates 222 and 322 comprise a second hardness profile different from the first hardness profile. In some embodiments, such as in FIG. 2B, the second hardness profile comprises a lowest or minimum hardness in a toe region 206, as shown by the dashed lines of region B, and a maximum hardness in the heel region 204 of second faceplate 211.

In other embodiments, such as in FIG. 3B, the second hardness profile comprises the lowest or minimum hardness in a heel region 304 of second faceplate 322, as shown by the dashed lines of region C, and a maximum hardness in the toe region 306.

Referring to FIGS. 2C and 3C, in many embodiments, third faceplates 233 and 333 comprise a third hardness profile. In some embodiments, such as in FIG. 2C, the third hardness profile comprises the lowest or minimum hardness profile in a top portion of third faceplate, as shown by the dashed lines of region D, 233, and a maximum hardness in a bottom portion of third faceplate 233.

In other embodiments, such as in FIG. 3C, the third hardness profile comprises the lowest or minimum hardness in a bottom portion of third faceplate 333, as shown by the dashed lines of region E, and a maximum hardness in a top portion of the third faceplate.

In many embodiments, the maximum hardness can range from 24-40 HRC, 30-35 HRC, 45-50 HRC, 50-60 HRC, or 24-60 HRC depending on the material of the faceplate and conditions the material are treated, as described in further detail below. Further, in many embodiments, the minimum hardness can range from 23-29 HRC, 30-42 HRC, 40-50 HRC, 42-50 HRC, or 23-50 HRC depending on the material and conditions the material are treated, as described in further detail below. In many embodiments, the difference between the maximum hardness and the minimum hardness can range from 2-40 HRC, from 5-30 HRC, from 10-20 HRC, or from 5-20 HRC.

In the illustrated embodiments, the hardness profiles vary discretely between the minimum and maximum hardness. In other embodiments, the hardness profiles can transition between regions of the faceplate gradually according to any profile. Further, in other embodiments the hardness profile can comprise a plurality of different hardness values positioned in a plurality of different locations on the faceplate. For example, the toe region may comprise the maximum hardness, the heel region may comprise the minimum hardness, and the center may comprise a hardness value in between the maximum and minimum hardness.

Further, the heel region, toe region, top portion, and bottom portion of the faceplate may vary in size. For example, the heel region, toe region, top portion, and bottom portion of the faceplate may comprise any percent of the faceplate, such as 25%, 30%, 35%, 40%, 45%, 50%, 55%, 60%, 65%, 70%, or 75%.

In many embodiments, the minimum hardness can comprise a surface area of the face plate greater than or equal to 0.97 $in^2$, greater than or equal to 1.0 $in^2$, greater than or equal to 1.25 $in^2$, greater than or equal to 1.5 $in^2$, greater than or equal to 1.75 $in^2$, or greater than or equal to 2.0 $in^2$. Further, the minimum hardness can comprise between 30-70%, 40%-60%, or 45-55% of the surface area of the faceplate. The minimum hardness can comprise 30%, 35%, 40%, 45%, 50%, 55%, 60%, 65% or 70% of the surface area of the faceplate. The minimum hardness can comprise greater than 20%, greater than 25%, greater than 30%, greater than 35%, greater than 40%, greater than 45%, or greater than 50% of the surface area of the face plate. In many embodiments, the minimum hardness comprises a greater percent of the surface area of the faceplate than a typical heat affected zone of a faceplate weld line (e.g. less than approximately 1.0 $in^2$).

In many embodiments, the maximum hardness can comprise a surface area of the face plate greater than or equal to 0.97 $in^2$, greater than or equal to 1.0 $in^2$, greater than or equal to 1.25 $in^2$, greater than or equal to 1.5 $in^2$, greater than or equal to 1.75 $in^2$, or greater than or equal to 2.0 $in^2$. Further, the maximum hardness can comprise between 30-70%, 40%-60%, or 45-55% of the surface area of the faceplate. The maximum hardness can comprise 30%, 35%, 40%, 45%, 50%, 55%, 60%, 65% or 70% of the surface area of the faceplate. The maximum hardness can comprise greater than 20%, greater than 25%, greater than 30%, greater than 35%, greater than 40%, greater than 45%, or greater than 50% of the surface area of the face plate. In many embodiments, the maximum hardness comprises a greater percent of the surface area of the faceplate than a typical heat affected zone of a faceplate weld line (e.g. less than approximately 1.0 $in^2$).

In other embodiments, the first, the second, and the third faceplates may have first, second, and third hardness profiles that are approximately the same while the position of a thickness profile varies from faceplate to faceplate to achieve the above described performance characteristics of the first, the second, and the third club heads, respectively. In other embodiments, the first, the second, and the third faceplates may have first, second, and third hardness profiles that vary as described herein, while the position of the thickness profile remains substantially constant from faceplate to faceplate to achieve the above described performance characteristics of the first, the second, and the third club heads, respectively.

B. Varying Thickness Profiles

Referring to FIGS. 4-5, set of faceplates 400 comprise varying thickness profiles, but only one of these faceplates is coupled to the golf club head body to provide different performance characteristics for the golf club. Each faceplate within the set of faceplates (e.g., faceplates 411, 422, and 433 of set of faceplates 400 (FIGS. 4-5)) comprise a thickness profile having a maximum thickness and a minimum thickness positioned in different regions of the faceplate.

In many embodiments, the thickness profile is substantially the same from faceplate to faceplate, but the position of the thickness profile relative to the geometric center of the faceplate varies for the first, the second, and the third faceplates. In other embodiments, the first faceplate may have a first thickness profile, the second faceplate may have a second thickness profile different than the first thickness profile, and the third faceplate may have a third thickness profile different from the second thickness profile.

Figure 5A:
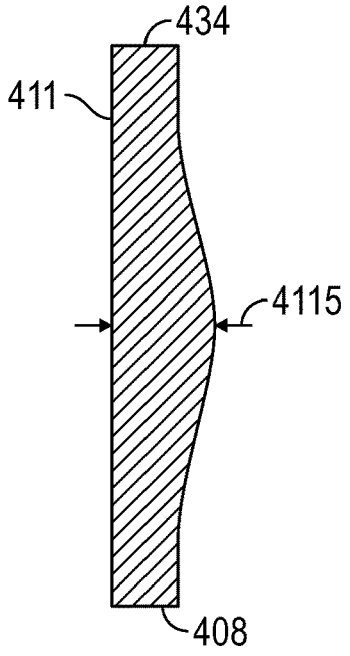
FIG. 5A depicts the faceplate within the set of faceplates of FIG. 4A across cross-sectional line 5A-5A in FIG. 4A.
Figure 5B:
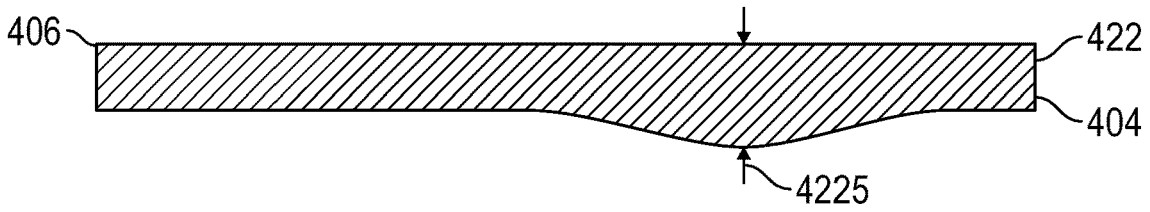
FIG. 5B depicts the faceplate within the set of faceplates of FIG. 4B across cross-sectional line 5B-5B in FIG. 4B.
Figure 5C:
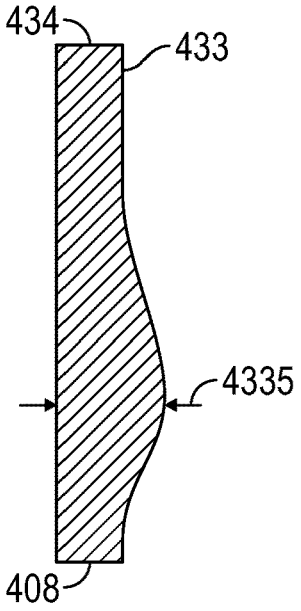
FIG. 5C depicts the faceplate within the set of faceplates of FIG. 4C across cross-sectional lines 5C-5C in FIG. 4C.

FIGS. 4A-4C depicts the set of faceplates 400. Set of faceplates 400 comprises a first faceplate 411, a second faceplate 422, and a third faceplate 433 comprising varying thickness profiles. FIGS. 5A-C depicts the set of faceplates 400 across the respective cross-sectional lines 5A-5A, 5B-5B, and 5C-5C shown in FIG. 4.

FIG. 5A depicts first faceplate 411 across a cross-sectional line 5A-5A of faceplate 411 (FIG. 4). In many embodiments, first faceplate 411 comprises a first thickness profile. In many embodiments, the first thickness profile comprises a maximum thickness 4115 at the approximate geometric center at point A and a minimum thickness surrounding the geometric center of first faceplate 411. In many embodiments, first faceplate 411 can be a standard faceplate similar to faceplates 211 (FIG. 2) and 311 (FIG. 3).

FIG. 5B depicts second faceplate 422 across a cross-sectional line 5B-5B of faceplate 422 (FIG. 4). In many embodiments, second faceplate 422 comprises a second thickness profile. In some embodiments, the second thickness profile comprises a maximum thickness 4225 toward the heel region 404 and a minimum thickness toward the toe region 406 of the second faceplate 422.

In other embodiments, the second thickness profile can comprise a maximum thickness toward the toe region 406 and a minimum thickness toward the heel region 404 of the second faceplate 422.

FIG. 5C depicts third faceplate 433 across a cross-sectional line 5C-5C of faceplate 433 (FIG. 4). In many embodiments, third faceplate 433 comprises a third thickness profile. In many embodiments, the third thickness profile comprises a maximum thickness 4335 toward the bottom portion and a minimum thickness toward the top portion of the third faceplate 433.

In other embodiments, the third thickness profile can comprise a maximum thickness toward the top portion 434 and a minimum thickness toward the bottom portion 408 of third faceplate 433.

In the illustrated embodiments, the thickness profiles vary gradually between the minimum and maximum hardness. In other embodiments, the thickness profiles can transition between regions of the faceplate according to any profile. Further, in other embodiments the thickness profile can comprise a plurality of different thickness values positioned in a plurality of different locations on the faceplate. For example, the toe region may comprise the maximum thickness, the heel region may comprise the minimum thickness, and the center may comprise a thickness value in between the maximum and minimum thickness.

In some embodiments, the golf club head can be a driver type club head, wherein the maximum thickness 4335 of the faceplate ranges from 0.105 inches (0.267 cm) to 0.17 inches (0.432 cm) and the minimum thickness of the faceplate ranging from 0.045 inches (0.114 cm) to 0.10 inches (0.254 cm). In some embodiments, the golf club head can be a fairway wood type club head, wherein the maximum thickness 4335 of the faceplate ranges from 0.065 inches (0.165 cm) to 0.14 inches (0.356 cm) and the minimum thickness of the faceplate ranges from 0.045 inches (0.114 cm) to 0.080 inches (0.203 cm). In some embodiments, the golf club head can be a hybrid type club head, wherein the maximum thickness 4335 of the faceplate ranges from 0.065 inches (0.165 cm) to 0.14 inches (0.356 cm) and the minimum thickness of the faceplate ranges from 0.04 inches (0.102 cm) to 0.08 inches (0.203 cm). In many embodiments, the difference between the maximum thickness and the minimum thickness can be between 0.005-0.050 inches, between 0.010-0.025 inches, or between 0.010-0.015 inches.

For example, referring to FIGS. 1 and 4-5, an exemplary driver type club head 100 comprises an exemplary faceplate having the variable thickness profile (e.g. faceplate 422, 433), wherein the faceplate comprises a 455 or 475 steel alloy (as discussed below). The exemplary faceplate has a maximum thickness ranging from 0.121 inches (0.307 cm) to 0.151 inches (0.384 cm) and a minimum thickness ranging from 0.071 inches (0.180 cm) to 0.101 inches (0.257 cm). The portion of the faceplate having the minimum thickness deflects more upon impact than the portion of the faceplate having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1 and 4-5, an exemplary fairway wood type club head 100 comprises an exemplary faceplate having the variable thickness profile (e.g. faceplate 422, 433), wherein the faceplate comprises a 455 or 475 steel alloy (as discussed below). The exemplary faceplate has a maximum thickness ranging from 0.088 inches (0.224 cm) to 0.118 inches (0.300 cm) a minimum thickness ranging from 0.058 inches (0.147 cm) to 0.078 inches (0.198 cm). The portion of the faceplate, having the minimum thickness deflects more upon impact than the portion of the faceplate 400 having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1 and 4-5, an exemplary fairway wood type club head 100 comprises an exemplary faceplate having the variable thickness profile (e.g. faceplate 422, 433), wherein the faceplate comprises a C300 steel alloy (as discussed below). The exemplary faceplate has a maximum thickness ranging from 0.063 inches (0.160 cm) to 0.093 inches (0.236 cm) and a minimum thickness ranging from 0.050 inches (0.127 cm) to 0.080 inches (0.203). The portion of the faceplate, having the minimum thickness deflects more upon impact than the portion of the faceplate having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1, and 4-5, an exemplary fairway wood type club head 100 comprises an exemplary faceplate having the variable thickness profile (e.g. faceplate 422, 433), wherein the faceplate comprises a 17-4 steel alloy (as discussed below). The exemplary faceplate has a maximum thickness ranging from 0.090 inches (0.229 cm) to 0.12 inches (0.305 cm) and a minimum thickness ranging from 0.057 inches (0.145 cm) to 0.087 inches (0.221 cm). The portion of the faceplate having the minimum thickness deflects more upon impact than the portion of the faceplate having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1, and 4-5, an exemplary hybrid type club head 100 comprises an exemplary faceplate having the variable thickness profile (e.g. faceplate 422, 433), wherein the faceplate comprises a 455 or 475 steel alloy (as discussed below). The exemplary faceplate has a maximum thickness ranging from 0.075 inches (0.191 cm) to 0.105 inches (0.267 cm) and a minimum thickness ranging from 0.050 inches (0.127 cm) to 0.08 inches (0.203 cm). The portion of the faceplate having the minimum thickness deflects more upon impact than the portion of the faceplate having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1, and 4-5, an exemplary hybrid type club head 100 comprises an exemplary faceplate having the variable thickness profile (e.g. faceplate 422, 433), wherein the faceplate comprises a C300 steel alloy (as discussed below). The exemplary faceplate has a maximum thickness ranging from 0.058 inches (0.147 cm) to 0.088 inches (0.224 cm) and a minimum thickness ranging from 0.045 inches (0.114 cm) to 0.075 inches (0.191 cm). The portion of the faceplate having the minimum thickness deflects more upon impact than the portion of the faceplate 400 having the maximum thickness. Variation in deflection across the faceplate can affect the spin about the horizontal and/or vertical axis dependent on the position of the maximum and minimum thickness, as discussed above with reference to FIGS. 4-5.

Referring to FIGS. 1, and 4-5, an exemplary hybrid type club head 100 comprises an exemplary faceplate having the variable thickness profile (e.g. faceplate 422, 433), wherein the faceplate comprises a 17-4 steel alloy (as discussed below). The exemplary faceplate has a maximum thickness ranging from 0.09 inches (0.229 cm) to 0.12 inches (0.305 cm) and a minimum thickness ranging from 0.06 inches (0.152 cm) to 0.09 inches (0.229 cm). The portion of the faceplate having the minimum thickness deflects more upon impact than the portion of the faceplate having the maximum thickness. Variation in deflection across the faceplate can affect the spin about the horizontal and/or vertical axis dependent on the position of the maximum and minimum thickness, as discussed above with reference to FIGS. 4-5.

C. Combination of Varying Hardness and Varying Thickness Profiles

While the embodiments described above include face plates having varying hardness profiles (e.g. faceplates 222, 233, 322, 333) or varying thickness profiles (e.g faceplates 422, 433), in other embodiments, the set of faceplates can include one or more of the varying hardness profiles and the varying thickness profiles.

In all the embodiments described above, the golf club head comprises an approximately similar or equal center of gravity (CG) regardless of which faceplate of the different sets of faceplates is coupled to the body of the golf club head. In some embodiments, the golf club head (e.g., golf club head 100 (FIG. 1)) comprises the first faceplate of the set of faceplates (e.g., first faceplate 211 or 311 (FIGS. 2-3) and/or first faceplate 411 (FIGS. 4-5). In some embodiments, the golf club head having the first faceplate of a particular set of faceplates comprises a first center of gravity, the golf club head having the second faceplate of the set of faceplates comprises a second center of gravity, and the golf club head having the third faceplate of the set of faceplates comprises a third center of gravity. In many embodiments, the first center of gravity, the second center of gravity, and the third center of gravity are approximately equal.

D. Effect of Varying Hardness and Thickness Profiles on Golf Ball Spin

In many embodiments, the first faceplate of the set of faceplates produces a first golf ball spin on impact with the golf ball, the second faceplate of the set of faceplates produces a second golf ball spin on impact with the golf ball, and the third faceplate of the set of faceplates produces a third golf ball spin on impact with the golf ball, when impacted with a particular speed and orientation. In many embodiments, the first golf ball spin comprises a first spin about a horizontal axis and a first spin about a vertical axis, the second golf ball spin comprises a second spin about the horizontal axis and a second spin about the vertical axis, and the third golf ball spin comprises a third spin about the horizontal axis and a third spin about the vertical axis.

Figure 6:
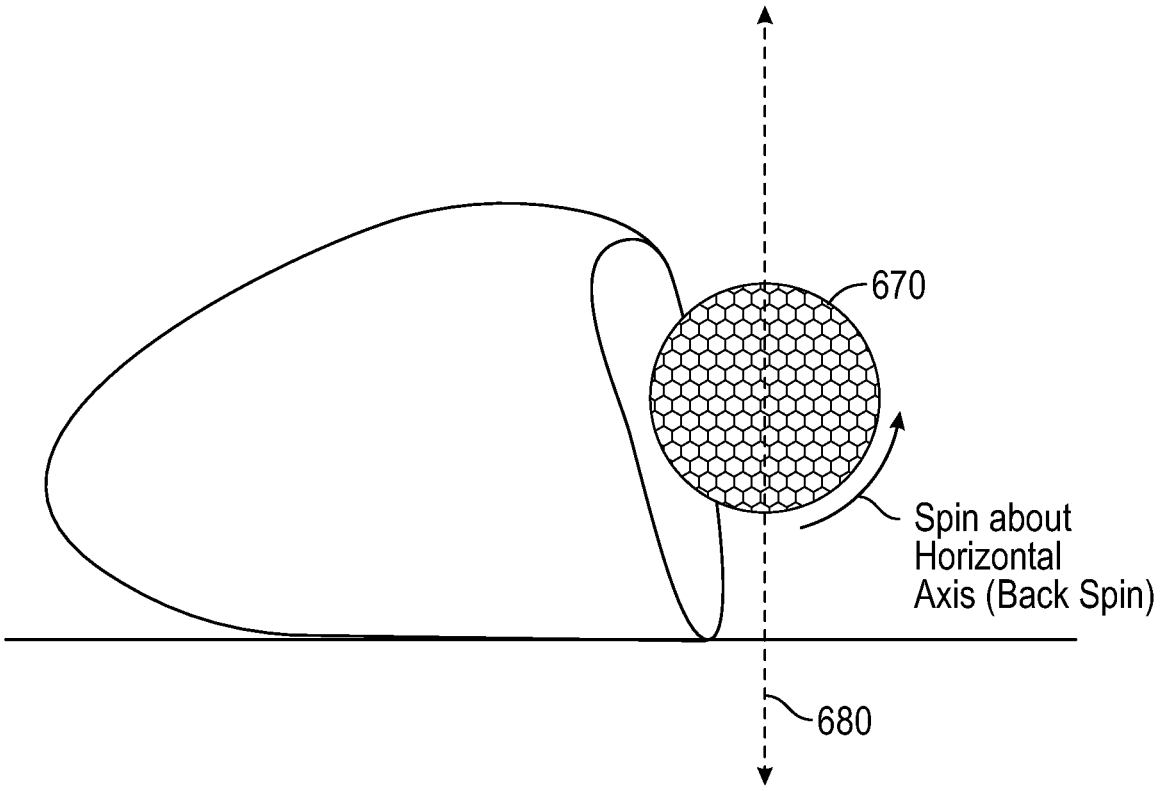
FIG. 6 depicts a side view of a golf club head according to an embodiment.

In many embodiments, the first spin about the horizontal axis can comprise a back spin (FIG. 6). FIG. 6 depicts a golf ball 670 upon impact with the faceplate (e.g., first faceplate 211 or 311 (FIGS. 2-3) and/or first faceplate 411 (FIGS. 4-5)). FIG. 6 shows a vertical axis 680 substantially perpendicular to the ground. The horizontal axis is perpendicular to vertical axis 680 and is coming out of the page. In many embodiments, referring to FIGS. 2-5, the second spin about the horizontal axis can be approximately equal to the first spin about the horizontal axis. In many embodiments, referring to FIGS. 2 and 4, the third spin about the horizontal axis can be less than the first spin about the horizontal axis. In other embodiments, referring to FIG. 3, the third spin about the horizontal axis can be greater than the first spin about the horizontal axis.

Referring to FIGS. 2 and 4, in many embodiments, the third faceplate 233, 433 can reduce spin about the horizontal axis (i.e. back spin) on the golf ball compared to the first faceplate 211, 411. The decrease in spin about the horizontal axis is a result of the third faceplate 233, 433 having the third hardness profile (e.g. lowest in the top region of the third faceplate), and/or the thickness profile position (e.g. thinner in the top region than the bottom region of the third faceplate). For example, referring to FIG. 2, the top portion of the third faceplate 233 having lower hardness deflects more on impact than the bottom portion of the third faceplate 233. Similarly, referring to FIGS. 4 and 5, the thinner top portion of the third faceplate 433 deflects more on impact than the thicker bottom portion of the third faceplate 433. Increased deflection of the top portion compared to the bottom portion of the third faceplate 233, 433 may reduce back spin about the horizontal axis compared to the golf ball impacted with the first faceplate 211, 411. Reduced back spin about the horizontal axis can assist in increasing the distance of the golf ball for a golfer that tends to hit the ball with significant back spin. Therefore, a golfer that tends to hit the ball with significant back spin may benefit from the use of the third faceplate 233, 433 of the set of faceplates 200, 400, where the reduced horizontal spin about the horizontal axis of the third faceplate 233, 433 reduces back spin allowing increased ball distance.

In other embodiments, referring to FIG. 3, the third faceplate 333 can increase spin about the horizontal axis (i.e. back spin) on the golf ball compared to the first faceplate 311. The increase in spin about the horizontal axis is a result of the third faceplate 333 having the third hardness profile (e.g. lowest in the bottom region of the third faceplate), and/or the thickness profile position (e.g. thinner in the bottom region than the top region of the third faceplate). For example, the bottom portion of the third faceplate 333 having lower hardness deflects more on impact than the top portion of the third faceplate 333. Similarly, the thinner bottom portion of the third faceplate (not shown) deflects more on impact than the thicker top portion of the third faceplate. Increased deflection of the bottom portion compared to the top portion of the third faceplate 333 may increase back spin about the horizontal axis compared to the golf ball impacted with the first faceplate 311. Increased back spin about the horizontal axis can assist in increasing the launch angle of the golf ball for a golfer that tends to hit the ball with low back spin. Therefore, a golfer that tends to hit the ball with low back spin may benefit from the use of the third faceplate 333 of the set of faceplates 300, where the increased horizontal spin about the horizontal axis of the third faceplate 333 increases back spin to increase launch angle of the golf ball.

Figure 7:
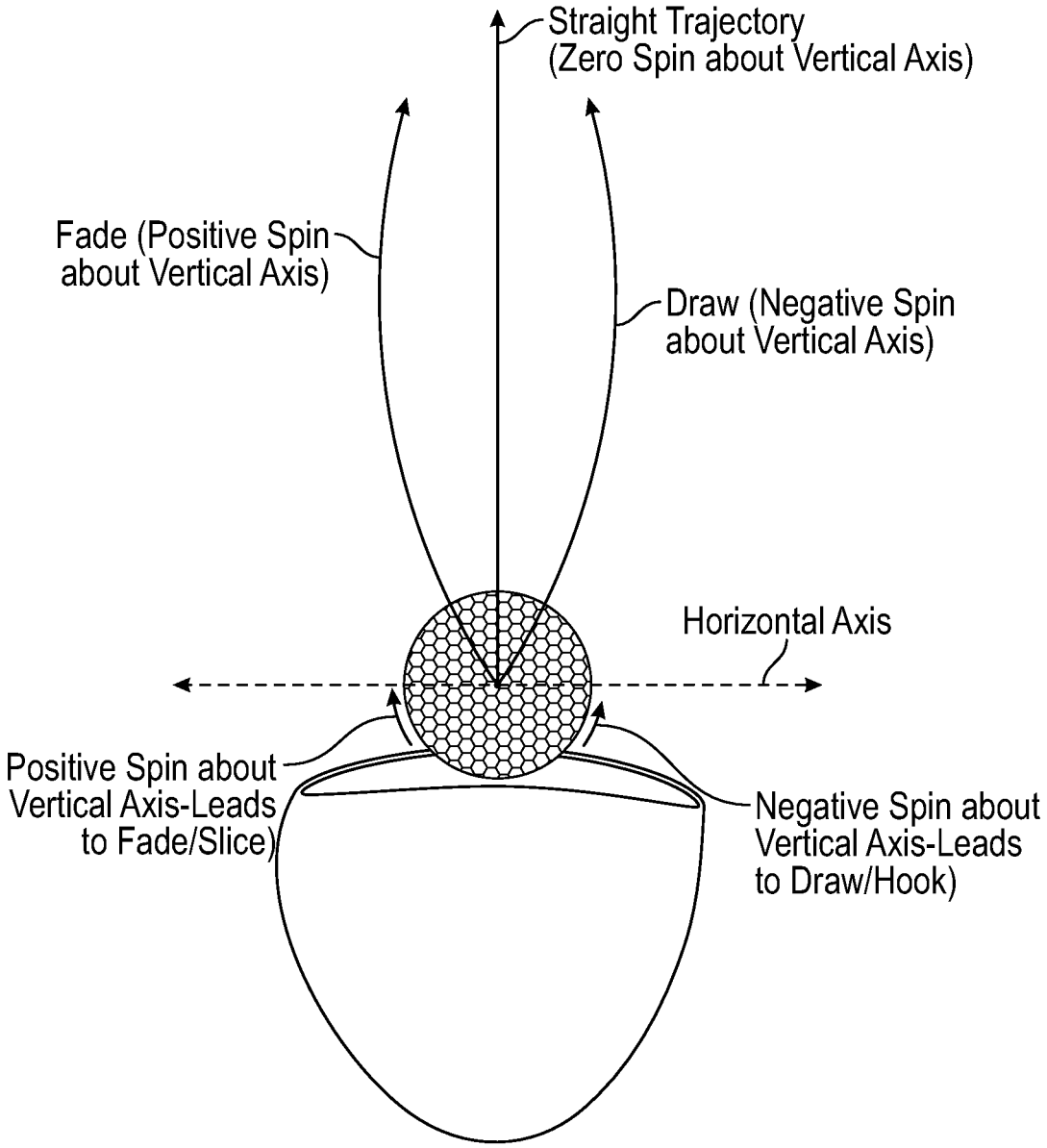
FIG. 7. depicts a top-down view of a golf club head and a golf ball direction upon impact with a faceplate according to an embodiment.
Figure 8:
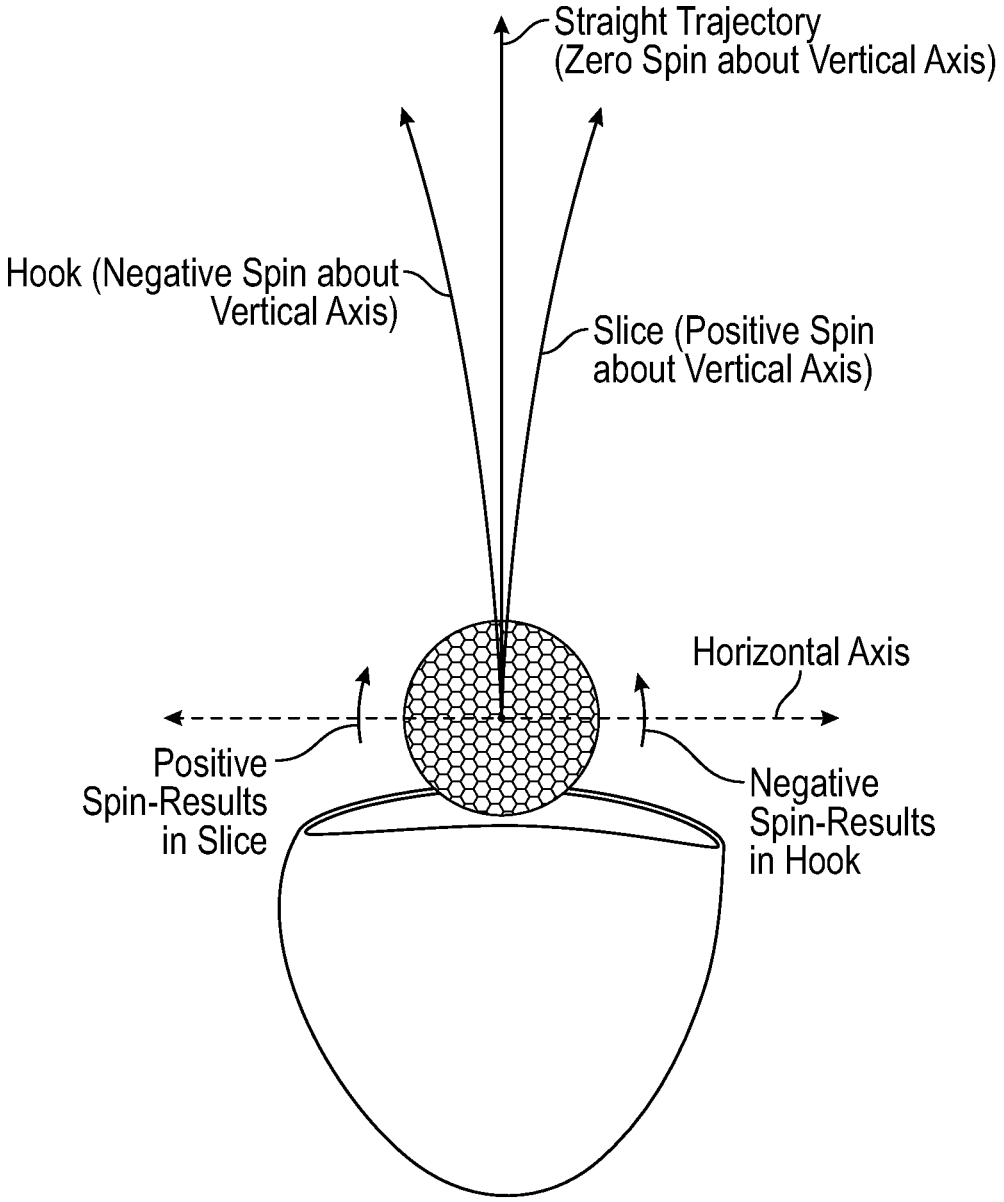
FIG. 8 depicts a top-down view of a golf club head and a golf ball direction upon impact with a faceplate according to another embodiment.

In some embodiments, the spin about vertical axis 680 can affect a direction of a golf ball. Vertical axis 680 is perpendicular to the horizontal axis and is substantially parallel with the direction of gravity. Referring to FIGS. 7-8, spin about vertical axis 680 can produce a hook or draw spin when the spin is a negative spin about vertical axis 680. Further, spin about vertical axis 680 can produce a slice when the spin is a fade or positive spin about the vertical axis. In some embodiments, the first spin about vertical axis 680 can produce a straight trajectory when there is zero or no spin about vertical axis 680. In many embodiments, referring to FIGS. 2 and 4, the second spin about vertical axis 680 is less than the first spin about vertical axis 680. When the second spin about vertical axis 680 is less than the first spin about vertical axis 680, a draw or negative spin can be produced. In other embodiments, referring to FIG. 3, the second spin about vertical axis 680 can be greater than the first spin about vertical axis 680. In many embodiments, referring to FIGS. 2-5 the third spin about vertical axis 680 is approximately equal to the first spin about vertical axis 680.

Referring to FIGS. 2 and 4, in embodiments where the second faceplate 222, 422 reduces spin about vertical axis 680 (e.g., the second spin about the vertical axis is less than the first spin about the vertical axis) on the golf ball compared to the first faceplate 211, 411, the reduced spin about vertical axis 680 results from the second faceplate 222, 422 having the second hardness profile (e.g. lowest in the toe region of the second faceplate), and/or the thickness profile position (e.g. thinner in the toe region than the heel region of the second faceplate). For example, referring to FIG. 2, the toe portion of the second faceplate 222 having lower hardness deflects more on impact than the heel portion of the second faceplate 222. Similarly, referring to FIGS. 4 and 5, the thinner toe portion of the second faceplate 422 deflects more on impact than the thicker heel portion of the second faceplate 422. Increased deflection of the toe portion compared to the heel portion of the second faceplate 222, 422 may reduce spin on the ball about the vertical axis, compared to the first faceplate 211, 411. Therefore, a golfer that tends to hit the golf ball with an open face can benefit from the use of the second faceplate 222, 422, wherein the draw spin of the second club head can assist in correcting the golf ball direction toward a target. Further, a golfer that tends to slice the ball may benefit from the use of the second faceplate 222, 422 of the set of faceplates 200, 400, where the draw or negative spin of the second faceplate 222, 422 can assist in correcting a slice by straightening the trajectory of the golf ball.

Referring to FIG. 3, in embodiments where the second faceplate 322 increases spin about vertical axis 680 (e.g., the second spin about the vertical axis is greater than the first spin about the vertical axis) on the golf ball compared to the first faceplate 311, the increased spin about vertical axis 680 results from the second faceplate 322 having the second hardness profile (e.g. lowest in the heel region of the second faceplate), and/or the thickness profile position (e.g. thinner in the heel region than the toe region of the second faceplate). For example, referring to FIG. 3, the heel portion of the second faceplate 322 having lower hardness deflects more on impact than the toe portion of the second faceplate 322. Similarly, the thinner heel portion of the second faceplate (not shown) deflects more on impact than the thicker toe portion of the second faceplate 322. Increased deflection of the heel portion compared to the toe portion of the second faceplate 322 may increase spin on the ball about the vertical axis, compared to the first faceplate 311. Therefore, a golfer that tends to hit the golf ball with a closed face can benefit from the use of the second faceplate 322, wherein the fade spin of the second club head can assist in correcting the golf ball direction toward a target. Further, a golfer that tends to hook the ball may benefit from the use of the second faceplate 322 of the set of faceplates 300, where the fade or positive spin of the second faceplate 322 can assist in correcting a hook by straightening the trajectory of the golf ball.

In many embodiments, club head 200 having faceplate 222 (FIG. 2B), club head 300 having faceplate 322 (FIG. 3B), and club head 400 having faceplate 422 (FIGS. 4B and 5B) can change the ball direction up to 10 yards, up to 15 yards, up to 20 yards, or up to 25 yards to the left or right.

Figure 9A:
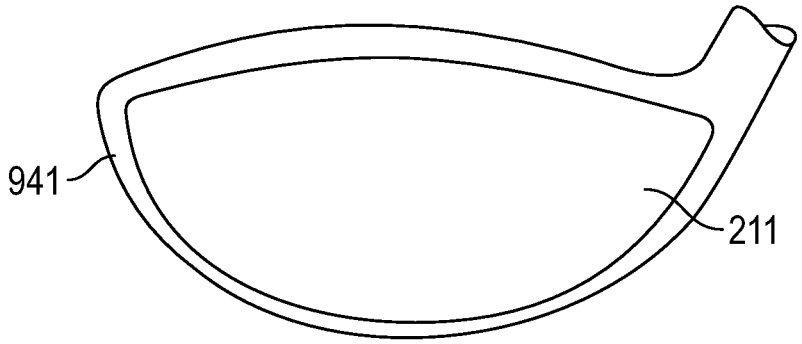
FIG. 9A depicts a golf club head within a set of golf club heads according to an embodiment.
Figure 9B:
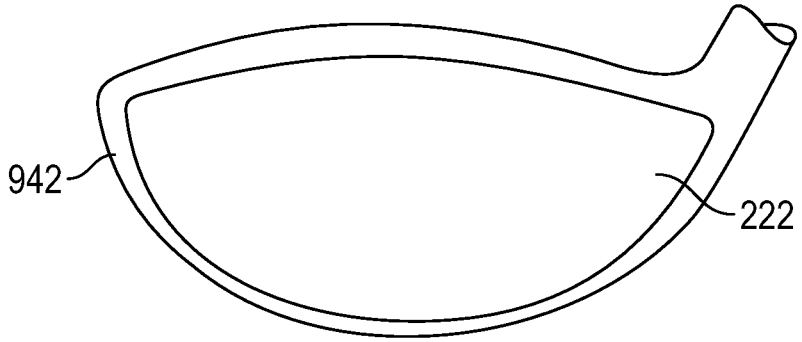
FIG. 9B depicts another golf club head within the set of golf club heads of FIG. 9A.
Figure 9C:
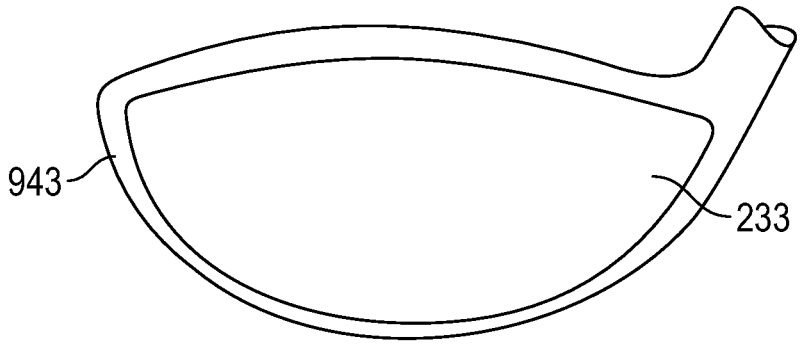
FIG. 9C depicts another golf club head within the set of golf club heads of FIGS. 9A and 9B.

In many embodiments, each faceplate within the sets of faceplates (e.g., sets of faceplates 200 and 300 (FIGS. 2-3) and/or set of faceplates 400 (FIGS. 4-5)) can be coupled to the same body design to form a set of golf club heads. FIG. 9 shows a set of golf club heads 900, wherein a first golf club head 941 comprises first faceplate (e.g. faceplate 211), a second golf club head 942 comprises second faceplate (e.g. faceplate 222), and a third golf club head 943 comprises third faceplate (e.g. faceplate 233).

Figure 10:
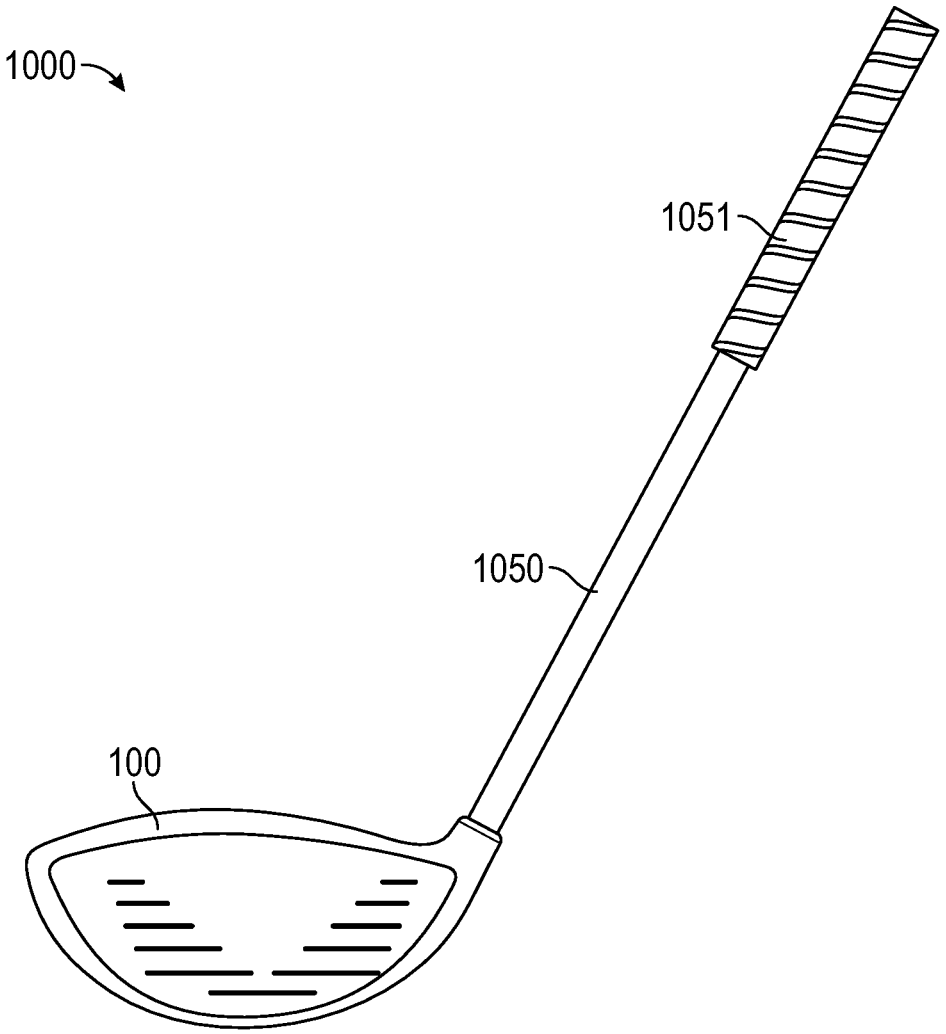
FIG. 10 depicts a golf club according to an embodiment.

In some embodiments, golf club head 100 (FIG. 1) can be part of a corresponding golf club. For example, a golf club 1000 in FIG. 10 can comprise golf club head 100 coupled to a shaft 1050 and a grip 1051 opposite golf club head 100. Golf club 1000 can comprise any of the golf club head with faceplate embodiments described herein, including first faceplate 211 or 311, second faceplate 222 or 322, or third faceplate 233 or 333 (FIGS. 2-3) and/or first faceplate 411, second faceplate 422, or third faceplate 433 (FIGS. 4-5)). Further, the golf club can be part of a set of golf clubs. Generally, club head 100 can comprise any suitable materials, but in many embodiments, club head 100 comprises one or more metal materials. Notwithstanding the foregoing, the apparatus, methods, and articles of manufacture described herein are not limited in this regard.

E. Method of Forming Varying Hardness Profiles

Figure 11:
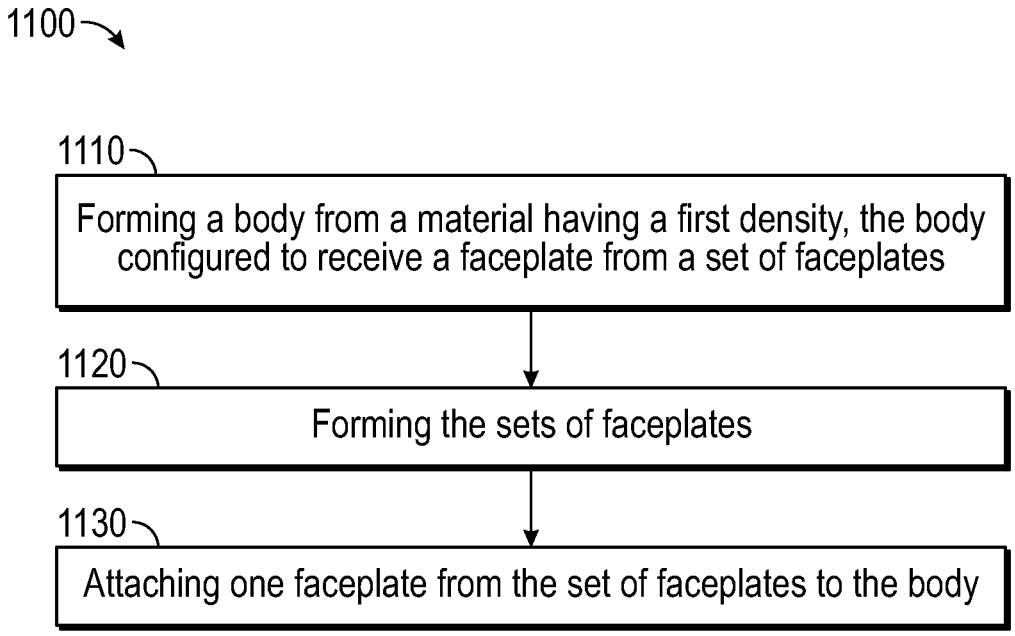
FIG. 11 depicts a method of manufacturing a golf club head according to an embodiment.
Figure 12:
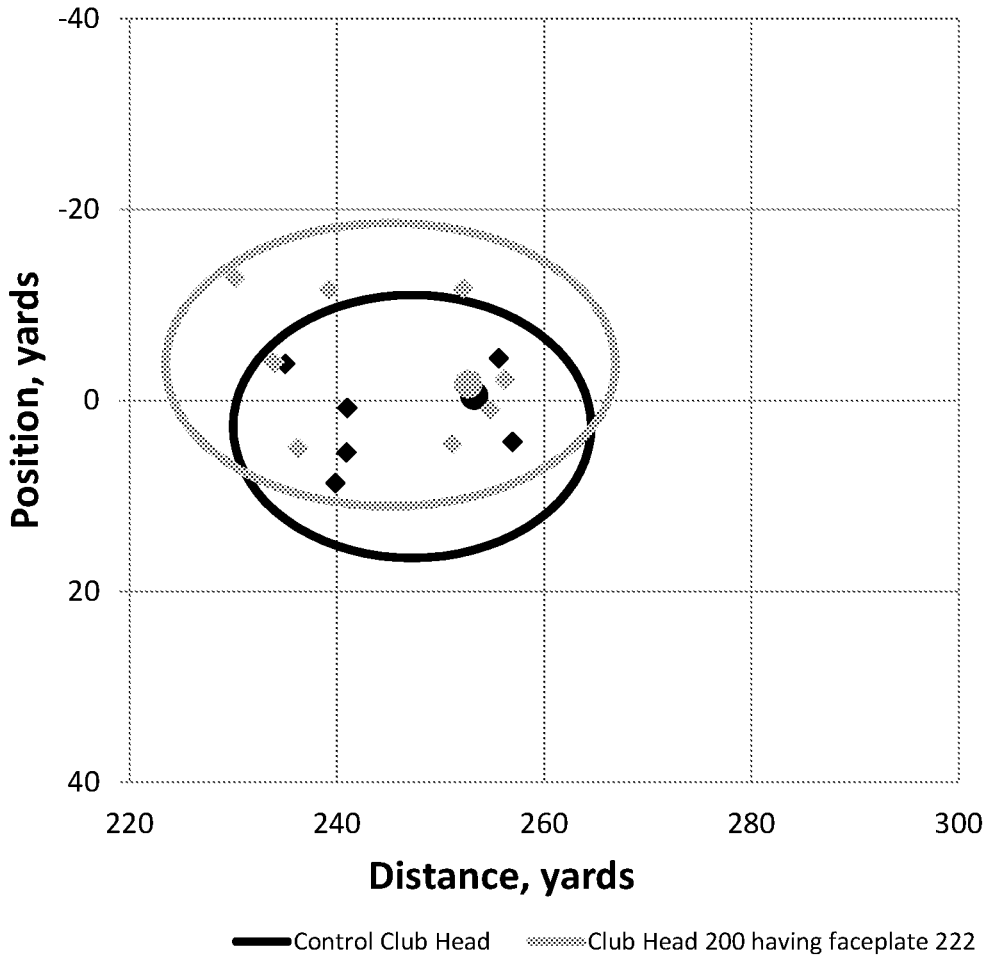
FIG. 12 depicts the landing positions of various golf balls as a result of impact with an exemplary golf club head of FIG. 2B, compared to the landing positions of various golf balls as a result of impact by a control golf club.

Some embodiments, such as the one shown in FIG. 11, include a method 1100 for manufacturing a golf club head (e.g., golf club head 100). In some embodiments, method 1100 comprises forming a body from a material having a first density, the body configured to receive a faceplate from a set of faceplates (block 1110). In many embodiments, the faceplate from the set of faceplates can comprise any of first faceplate 211 or 311, second faceplate 222 or 322, or third faceplate 233 or 333 (FIGS. 2-3) and/or first faceplate 411, second faceplate 422, or third faceplate 433 (FIGS. 4-5). In many embodiments, the body comprises a heel region, a toe region opposite the heel region, a sole, and a crown. In some embodiments, method 1000 further comprises forming the set of faceplates (block 1120), and attaching one faceplate from the set of faceplates to the body (block 1130). Attaching the faceplate to the body can include welding or brazing the faceplate to the body, and/or can include another attachment technique such as epoxying and the like.

In many embodiments, the set of faceplates comprises at least one of the varying hardness profile or the varying thickness profile. The varying hardness profile can be achieved by selective heating of a portion of the faceplate to reduce the hardness. Selectively heating a portion of the faceplate can be accomplished using a variety of methods including laser heat treating, induction heating, using an insulated furnace, conventional heating, or any other suitable method or combination of methods. All of the above mentioned heat treatments can be followed by a fast cooling or gradient cooling step.

In many embodiments, the varying hardness profile can be produced by a variation in heat treatment of portions of each faceplate of the set of faceplates. Specifically, different portions of each faceplate may be heat treated using a laser for direct application at different temperatures and/or for different durations to optimize the hardness of different portions of the faceplate. Further, different portions of each faceplate may be heat treated using a laser for direct application at different temperatures and/or for different durations such that the varying hardness profile is formed throughout the entire thickness of each faceplate within the set of faceplates. Temperatures and durations required to achieve a specific hardness may vary for different faceplate designs and materials. Such heat treatment can include the heat treatment method taught by U.S. patent application Ser. No. 14/624,488 entitled "Heat Treatment," filed on Feb. 17, 2015, which is herein incorporated by reference.

i. Faceplate Comprising 17-4 Steel Alloy

In some embodiments the faceplate can be made of a 17-4 steel alloy having approximately 15.0-17.5% chromium, approximately 3.0-5.0% copper, approximately 3.0-5.0% nickel, less than 1.0% manganese, less than 1.0% silicon, with the remaining alloy composition being iron and other trace elements including 0.07% carbon, 0.15-0.45% niobium, 0.15-0.45% tantalum, less than 0.04% phosphorus, and less than 0.03% sulfur.

In these or other embodiments, heat treating at higher temperatures and longer durations (for a specific range of temperatures and durations) reduces the hardness or softens portions of the faceplate being heat treated. In these or other embodiments, the faceplate can undergo a first heat treatment across the entire faceplate to reach the maximum desired hardness. In these or other embodiments, the first heat treatment can comprise heating the faceplate at approximately 900 degrees Fahrenheit for 1-4 hours. A portion of the faceplate can undergo an additional, second heat treatment to soften the portion of the faceplate to the desired minimum hardness. In these or other embodiments, the second heat treatment can comprise heat treating the desired softer portion of the faceplate at approximately 932-1,292 degrees Fahrenheit for 1-4 hours.

Further, in these or other embodiments, the minimum hardness of the faceplate can range from approximately 23-37 HRC and the maximum hardness of the faceplate can range from approximately 34-45 HRC. For example, the maximum hardness can be approximately 34, 35, 36, 37, 38, 39, 40, 41, 42, 43, 44, or 45 HRC and the minimum hardness can be approximately 23, 24, 25, 26, 27, 28, 29, 30, 31, 32, 33, 34, 35, 36, or 37 HRC.

Further, in these or other embodiments, the yield strength in the region of the faceplate comprising the maximum hardness is greater than the yield strength of the region of the faceplate comprising the minimum hardness. For example, the yield strength in the region of the faceplate comprising the maximum hardness can be between 75-115 ksi, and the yield strength in the region of the faceplate comprising the minimum hardness can be between 160-200 ksi.

ii. Faceplate Comprising C300 Steel Alloy

In some embodiments, the faceplate can be made of a C300 steel alloy having approximately 18.0-19.0% nickel, approximately 8.5-9.5% cobalt, approximately 4.6-5.2% molybdenum, with the remaining alloy composition being iron and other trace elements including 0.5-0.8% titanium, 0.05-0.15% aluminum, less than approximately 0.5% chromium, less than approximately 0.5% copper, less than approximately 0.1% manganese, less than approximately 0.1% silicon, less than approximately 0.3% carbon, less than approximately 0.01% phosphorus, and less than approximately 0.01% sulfur.

In these or other embodiments, heat treating at higher temperatures and longer durations (for a specific range of temperatures and durations) reduces the hardness or softens portions of the faceplate being heat treated. In some embodiments, the faceplate can undergo a first heat treatment across the entire faceplate to reach the maximum hardness. In these or other embodiments, the first heat treatment can comprise heating the faceplate at approximately 850 degrees Fahrenheit for 1-3 hours. A portion of the faceplate can undergo an additional, second heat treatment to soften the portion of the faceplate to the desired minimum hardness. In these or other embodiments, the second heat treatment can comprise heat treating the desired softer portion of the faceplate at approximately 1,000 degrees Fahrenheit for 1-6 hours.

Further, in these or other embodiments, the minimum hardness of the faceplate can range from approximately 42-52 HRC and the maximum hardness of the faceplate can range from approximately 50-60 HRC. For example, the maximum hardness can be approximately 50, 51, 52, 53, 54, 55, 56, 57, 58, 59, or 60 HRC and the minimum hardness can be approximately 42, 43, 44, 45, 46, 47, 48, 49, 50, 51, or 52 HRC.

Further, in these or other embodiments, the yield strength in the region of the faceplate comprising the maximum hardness is greater than the yield strength of the region of the faceplate comprising the minimum hardness. For example, the yield strength in the region of the faceplate comprising the maximum hardness can be between 275-325 ksi, and the yield strength in the region of the faceplate comprising the minimum hardness can be between 225-275 ksi.

iii. Faceplate Comprising 455 Steel Alloy

In some embodiments the faceplate can be made of a 455 steel alloy having approximately 11-12.5% chromium, approximately 7.5-9.5% nickel, approximately 1.5-2.5% copper, approximately 0.80-1.4 titanium, with the remaining alloy composition being iron and other trace elements including approximately 0.1-0.5% columbium+tantalum, less than approximately 0.5% molybdenum, less than approximately 0.5% manganese, less than approximately 0.5% silicon, less than approximately 0.05% carbon, less than approximately 0.04% phosphorus, and less than approximately 0.03% sulfur.

In these or other embodiments, heat treating at higher temperatures and longer durations (for a specific range of temperatures and durations) reduces the hardness or softens portions of the faceplate being heat treated. In some embodiments, the faceplate can undergo a first heat treatment across the entire faceplate to reach the maximum hardness. In these or other embodiments, the faceplate can undergo a first heat treatment across the entire faceplate to reach the maximum desired hardness. The first heat treatment can comprise heating the faceplate at approximately 900 degrees Fahrenheit for 1-4 hours. A portion of the faceplate can undergo an additional, second heat treatment to soften the portion of the faceplate to the desired minimum hardness. The second heat treatment can comprise heat treating the desired softer portion of the faceplate at approximately 1,000 degrees Fahrenheit for 1-4 hours.

Further, in these or other embodiments, the minimum hardness of the faceplate can range from approximately 40-50 HRC and the maximum hardness of the faceplate can range from approximately 45-55 HRC. For example, the maximum hardness can be approximately 45, 46, 47, 48, 49, 40, 51, 52, 53, 54, or 55 HRC and the minimum hardness can be approximately 40, 41, 42, 43, 44, 45, 46, 47, 48, 49, or 50 HRC.

Further, in these or other embodiments, the yield strength in the region of the faceplate comprising the maximum hardness is greater than the yield strength of the region of the faceplate comprising the minimum hardness. For example, the yield strength in the region of the faceplate comprising the maximum hardness can be between 225-275 ksi, and the yield strength in the region of the faceplate comprising the minimum hardness can be between 190-230 ksi.

iv. Faceplate Comprising 475 Steel Alloy

In some embodiments the faceplate can be made of a 475 steel alloy having approximately 10.5-11.5% chromium, approximately 8.0-9.0% cobalt, approximately 7.5-8.5% nickel, approximately 4.5-5.5% molybdenum, approximately 1.0-1.5% aluminum, with the remaining alloy composition being iron and other trace elements including less than approximately 0.5% silicone, less than approximately 0.5% manganese, less than approximately 0.02% carbon, less than approximately 0.015% phosphorus, and less that 0.01% sulfur.

In these or other embodiments, heat treating at higher temperatures and longer durations (for a specific range of temperatures and durations) reduces the hardness or softens portions of the faceplate being heat treated. In some embodiments, the faceplate can undergo a first heat treatment across the entire faceplate to reach the maximum hardness. In these or other embodiments, the faceplate can undergo a first heat treatment across the entire faceplate to reach the maximum desired hardness. The first heat treatment can comprise heating the faceplate at approximately 975 degrees Fahrenheit for 1-4 hours. A portion of the faceplate can undergo an additional, second heat treatment to soften the portion of the faceplate to the desired minimum hardness. The second heat treatment can comprise heat treating the desired softer portion of the faceplate at approximately 1,100 degrees Fahrenheit for 1-4 hours.

Further, in these or other embodiments, the minimum hardness of the faceplate can range from approximately 40-50 HRC and the maximum hardness of the faceplate can range from approximately 50-60 HRC. For example, the maximum hardness can be approximately 40, 41, 42, 43, 44, 45, 46, 47, 48, 49 or 50 HRC and the minimum hardness can be approximately 50, 51, 52, 53, 54, 55, 56, 57, 58, 59, or 60 HRC.

Further, in these or other embodiments, the yield strength in the region of the faceplate comprising the maximum hardness is greater than the yield strength of the region of the faceplate comprising the minimum hardness. For example, the yield strength in the region of the faceplate comprising the maximum hardness can be between 250-290 ksi, and the yield strength in the region of the faceplate comprising the minimum hardness can be between 170-210 ksi.

In these embodiments, the second heat treatment used to soften a portion of the faceplate can be accomplished using a laser capable of directing or isolating the treatment to the desired softened portion of the faceplate. In these embodiments, the first and second heat treatment result in the hardness profile being formed throughout the thickness of the faceplate. In other embodiments, the second heat treatment can be accomplished using any other suitable method. Further, in other embodiments, the faceplate can undergo any number of heat treatments resulting in any number of hardness regions on the faceplate.

In other embodiments, increasing heat treatment temperatures and/or durations can increase material hardness. In these embodiments, other methods may be used to achieve variation in the hardness profile of the faceplates. In some embodiments, the heat treatment at a first temperature for a first duration can reduce a hardness of a region of each faceplate of the set of faceplates. In some embodiments, a lowest hardness region of the faceplate of the set of faceplates can be heat treated at the first temperature of approximately 900 degrees Fahrenheit for the first duration of approximately one to four hours. In many embodiments, the remaining region of the faceplate of the set of faceplates can be heat treated at a second temperature of approximately 1,000 degrees Fahrenheit for a second duration; the second duration is approximately one to four hours.

The golf club head with variable face geometry and material properties discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for variable face geometry and material properties, and may disclose alternative embodiments of golf club heads with variable face geometry and material properties.

EXAMPLE 1

An exemplary golf club head 200 comprising an exemplary faceplate 222 having a varying hardness profile was compared with a control club head similar to exemplary club head 200 except having a faceplate with a substantially constant hardness. The exemplary faceplate 222 comprises a 17-4 steel alloy and has a minimum hardness in the toe region 206 of approximately 36 HRC and a maximum hardness in the heel region 204 of approximately 44 HRC. The hardness profile of the faceplate 222 is achieved by heat treating the entire club head at 896 degrees Celsius followed by a laser heat treatment to the toe region 206 of the faceplate 222 at 932-1,292 degrees Celsius for 1-4 hours. The control club head comprises a hardness of approximately 44 HRC. The exemplary club head 200 showed an average shift in golf ball direction of up to 17.1 yards (6.5 yards on average) to the left, compared to the control club head.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf clubs such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a fairway type golf club head having a body configured to receive a faceplate, the body comprising:

a heel region;

a toe region opposite the heel region;

a sole; and a crown; and the faceplate coupled to the body;

the faceplate comprising a varying hardness profile and a varying thickness profile;

wherein the faceplate comprises a heel region, a toe region, a top portion, and a bottom portion, and further comprises:

a hardness profile and a thickness wherein the hardness profile comprises a minimum hardness in the toe region of the faceplate and a maximum hardness in the heel region of the faceplate; and the thickness profile comprises a maximum thickness toward the heel region of the faceplate and a minimum thickness toward the toe region of the faceplate;

wherein the maximum thickness ranges from 0.09 inches to 0.12 inches; and the minimum thickness ranges from 0.06 inches to 0.09 inches;

wherein the faceplate consists of a single material;

wherein the single material is a 17-4 steel alloy having approximately 15.0-17.5% chromium, approximately 3.0-5.0% copper, approximately 3.0- 5.0% nickel, less than 1.0% manganese, less than 1.0% silicon, with the remaining alloy composition being iron and other trace elements including 0.07% carbon, 0.15-0.45% niobium, 0.15-0.45% tantalum, less than 0.04% phosphorus, and less than 0.03% sulfur;

wherein a yield strength in the heel region is greater than a yield strength of the toe region;

and wherein the faceplate comprises a c-cup design such that a portion of the crown and sole are formed by the faceplate.

2. The golf club head of claim 1, wherein:

the maximum hardness is between- 34-45 HRC;

the minimum hardness is between 24-37 HRC; and the minimum hardness comprises greater than 45% of a surface area of the faceplate.

3. The golf club head of claim 1, wherein:

the golf club head comprising the faceplate comprises:

a center of gravity; and produces a golf ball spin, the golf ball spin comprises a spin about a horizontal axis and a spin about a vertical axis.

* * * * *